United States Patent [19]

Altmann et al.

[11] Patent Number: 4,662,342

[45] Date of Patent: May 5, 1987

[54] PRESSURE WAVE SUPERCHARGER FOR AN INTERNAL COMBUSTION ENGINE WITH A DEVICE FOR CONTROLLING THE HIGH PRESSURE EXHAUST GAS FLOW

[75] Inventors: Karel Altmann, Nussbaumen; Andreas Mayer, Niederrohrdorf; Josef Perevuznik, Fislisbach, all of Switzerland

[73] Assignee: BBC Brown, Boveri & Company, Limited, Baden, Switzerland

[21] Appl. No.: 854,618

[22] Filed: Apr. 22, 1986

[30] Foreign Application Priority Data

Apr. 30, 1985 [CH] Switzerland ..... 1831/85

[51] Int. Cl.[4] ..... F02B 33/42

[52] U.S. Cl. ..... 123/559; 417/64

[58] Field of Search ..... 60/39.54 R, 39.54 A, 60/600, 601, 602, 603; 123/559, 564; 417/64

[56] References Cited

U.S. PATENT DOCUMENTS 4,488,532 12/1984 Mayer ..... 123/559

FOREIGN PATENT DOCUMENTS 173312 9/1985 Japan ..... 123/559

*Primary Examiner*—Stephen F. Husar

*Attorney, Agent, or Firm*—Burns, Doane, Swecker & Mathis

[57] ABSTRACT

In the high pressure exhaust gas duct of a pressure wave supercharger, a rotary valve is supported in the region where the gas pocket supply branches off from the high pressure exhaust gas duct, the angular position of the rotary valve being controlled either in steps or steplessly by one or more parameters typical of the pressure wave process and, if necessary, of the engine working process or the engine operating condition. Depending on the operating condition, the rotary valve closes the high pressure exhaust gas duct and the gas pocket supply duct completely or partially. Control is preferably carried out by a step motor with characteristics control by an in-process computer.

11 Claims, 21 Drawing Figures

FIG. 3
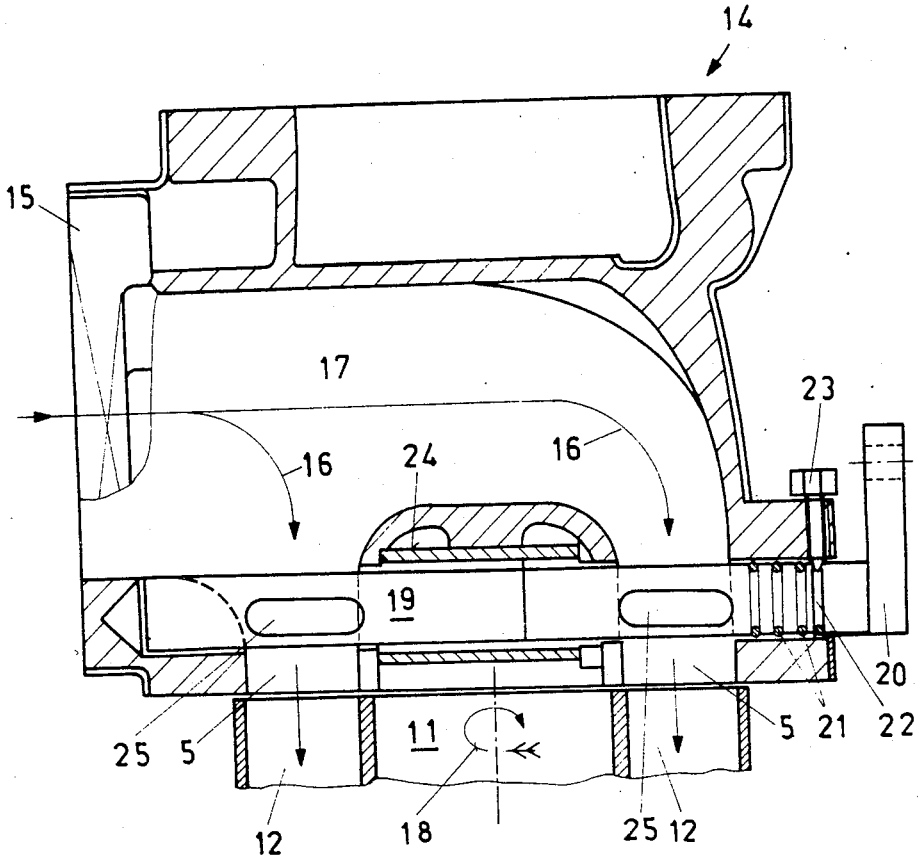
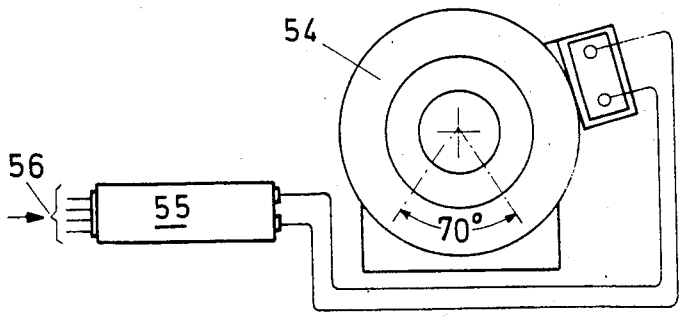
FIG. 9

PRESSURE WAVE SUPERCHARGER FOR AN INTERNAL COMBUSTION ENGINE WITH A DEVICE FOR CONTROLLING THE HIGH PRESSURE EXHAUST GAS FLOW

FIELD OF THE INVENTION

The present invention relates to a pressure wave supercharger for an internal combustion engine with a device for controlling the high pressure exhaust gas flow.

BACKGROUND OF THE INVENTION

In conventional pressure wave superchargers for internal combustion engines, a gas pocket is provided in the gas casing between each high pressure exhaust gas duct and low pressure exhaust gas duct. Part of the high pressure exhaust gas flow expelled from the engine is branched off into this gas pocket in order, in conjunction with an expansion pocket provided in the air casing, to improve the low pressure scavenging, i.e., the scavenging of the expanded exhaust gas from the rotor cells. The result of good low pressure scavenging is reduced exhaust gas recirculation, i.e., the penetration of exhaust gas into the combustion air is reduced. A large amount of exhaust gas recirculation in the idling range would adversely affect the even running of the engine.

Branching off high pressure exhaust gas into the gas pocket does, however, reduce the energy available for compressing the supercharge air. As full load, there is a wide range of speeds and temperatures within which this energy would be the desirable in order to increase the power of the engine. It would be possible to utilize this energy within this operating range if the supply of high pressure exhaust gas into the gas pocket was prevented under this condition because the low pressure scavenging is always ensured at full load. The gas pocket is therefore superfluous under this operating condition.

It follows that a gas pocket of this type with a constant inlet flow cross-section represents a compromise which accepts the fact that the energy of the high pressure exhaust gases is not used for compressing the supercharge air in the best possible way over the whole of the operating range of the engine. Shutting off the supply to the gas pocket in the lower full load range, permits better matching between the supercharge air supply from the pressure wave supercharger and the air requirements of the engine.

The present invention arose from the objective, based on the above consideration, of dividing the high pressure exhaust gas flow emerging from the engine into a main flow through the high pressure exhaust gas duct and a portion branched into the gas pocket in a relatively simple manner and in a way matched to the particular power range of the engine.

Two possible ways of feeding the gas pocket are known. The simpler consists of a narrow connecting duct between the high pressure exhaust gas duct and the gas pocket on the end surface of the gas casing facing the rotor. In this case, the static pressure in the gas pocket is that present in the main flow and this type of feed is therefore called static gas pocket feed. The second possibility is the total pressure feed in which a gas pocket duct is branched off from the high pressure exhaust gas duct into the gas pocket before the latter duct enters the rotor space. The gas pocket duct is then located in such a way that the gas flow branched off is only slightly deflected relative to the direction of the main flow. As a result, the dynamic pressure of the gas velocity is also effective in the gas pocket in addition to the static pressure. In a device of this type with total pressure feed, known from EP-PS No. 0 039 375, an attempt is made to control the supply to the gas pocket, and hence the division of the high pressure exhaust gas flow, by means of a bimetal flap. This is clamped with one end in the gas casing at the beginning of the gas pocket supply duct and permits completely free supply to the gas pocket at room temperature. During operation, the bimetal flap bends as a function of the exhaust gas temperature in such a way that the gas pocket supply is initially only slightly reduced with increasing temperature, for the purpose of good low pressure scavenging. The supply cross-section becomes gradually smaller with increasing exhaust gas temperature and finally, in the upper load range, is fully closed in order to make as much exhaust gas energy as possible available for compressing the supercharge air.

This device does not, however, permit the flap position to be controlled in an ideal manner, such as that demanded by the engine as a function of the particular operating condition, because the behavior of the flap metal cannot be matched reliably to the particular temperature. In addition, the flap may be subject to grain structure changes which, after longer operating periods, change the curvature as a function of the temperature. A further fault is the delayed response of the flap deformation to changes in temperature, which again prevents the desired coordination between the flap adjustment and the operating condition. Another particular disadvantage, however, is that such a device cannot control the flap position as a function of the supercharge pressure by means of a characteristic stored in a microprocessor. It is only such a control system, however, which permits optimum matching between the supply to the gas pocket and the particular operating condition of the engine.

The present invention arose from the requirement for such a device, preferably controlled by characteristic curves, for matching the total pressure feed to the operating condition of the engine. Such a control device ensures that the supercharge air flow of the pressure wave supercharger approximates as well as possible to the maximum over the whole operating range of the engine.

In addition to the controllable division, already mentioned, of the high pressure exhaust gas flow into a main flow for compressing the supercharge air and into a gas pocket flow for improving the low pressure scavenging, the invention also has the objective of making a change in the degree of recirculation, i.e., the proportion of exhaust gas penetrating into the supercharge air. This is accomplished by means of a special embodiment, in order to ensure the observance of limiting values of oxides of nitrogen which may possibly be required by law.

By appropriate dimensioning and control of the supply to the gas pocket, it is also possible, using a special variant, to reduce the maximum supercharge pressure or the maximum pressure ratio to the allowable maximum value so that a separate wastegate, which is the blow-down valve for excessive supercharge pressure, becomes unnecessary.

BRIEF DESCRIPTION OF THE DRAWINGS

The invention is described in more detail below using the embodiment examples shown in the drawings.

In the drawings:

FIG. 9 shows an actuating device for the rotary valve.

DETAILED DESCRIPTION OF THE INVENTION

Where, in the following description, elements in the various embodiments forms fulfill the same functions, they have the same reference numbers allocated to them.

Figure 1:
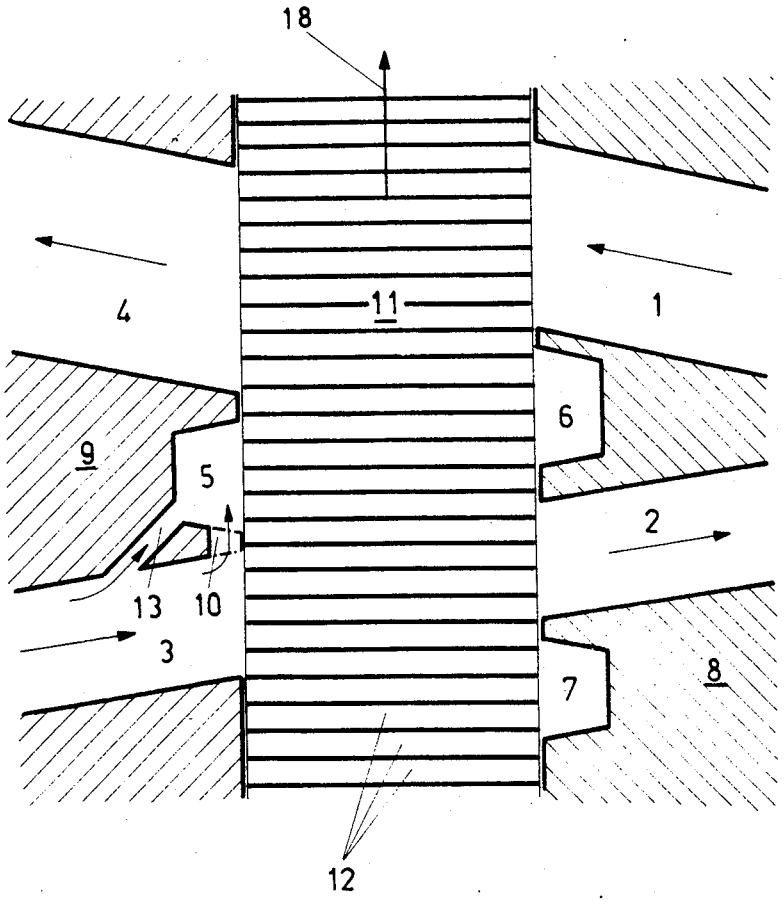
FIG. 1 shows, diagrammatically, a developed cylindrical section through the cells of a rotor and through the gas and air casings of a pressure wave supercharger for the purpose of fixing the designations used in the description, FIGS. 2 and 3, respectively, show a gas casing in elevation and a side view of the same in section, with a device for controling the supply to the gas pocket.

FIG. 1 shows a development of a cylindrical section through the mid-height of the rotor cells and also the main and auxiliary ducts for one cycle of the pressure wave supercharger. A cycle should here be understood to mean the totality of the main and auxiliary ducts, as shown in FIG. 1, which are necessary for a correctly functioning pressure wave process. Generally speaking, the currently known and practically usable pressure wave superchargers have two cycles whose ducts are arranged over half the respective peripheries of the gas and air casings.

The four main ducts of such a cycle are indicated by 1–4 in FIG. 1. These are the low pressure air duct 1, through which air at atmospheric pressure enters, the high pressure air duct 2, through which the compressed supercharge air flows into the engine cylinder, the high pressure exhaust gas duct 3, through which the combustion gases expelled from the engine flow into the rotor cells 12 of the rotor 11 and compress the low pressure air located in them, and the low pressure exhaust gas duct 4, from which the combustion gases expanded in the rotor cells 12 exhaust into the open air. Present as auxiliary ducts in the gas casing 9 are a gas pocket 5, which accepts part of the high pressure exhaust gas and, as described at the beginning, improves the low pressure scavenging in conjunction with an expansion pocket 6, and a compression pocket 7 in the air casing 8 for the precompression of the supercharge air at low rotational speeds. By this means, in contrast to the exhaust gas turbocharger, a usable supercharge pressure is developed even in the lower speed range.

Known ways of feeding the gas pocket 5 are, as mentioned at the beginning, purely static pressure feed, which is obtained by a flat gas pocket supply 10 provided on the end surface of the gas casing 9, and total pressure feed, whose control is the subject matter of the present invention. A gas pocket supply duct 13 branching from the high pressure exhaust gas duct 3 at the sharpest possible angle is used for feed in the type last mentioned. The simultaneous presence of the duct 10 is of advantage in particular cases. If the duct 10 is not employed, the chain-dotted boundaries of the ducts apply.

Figure 2:
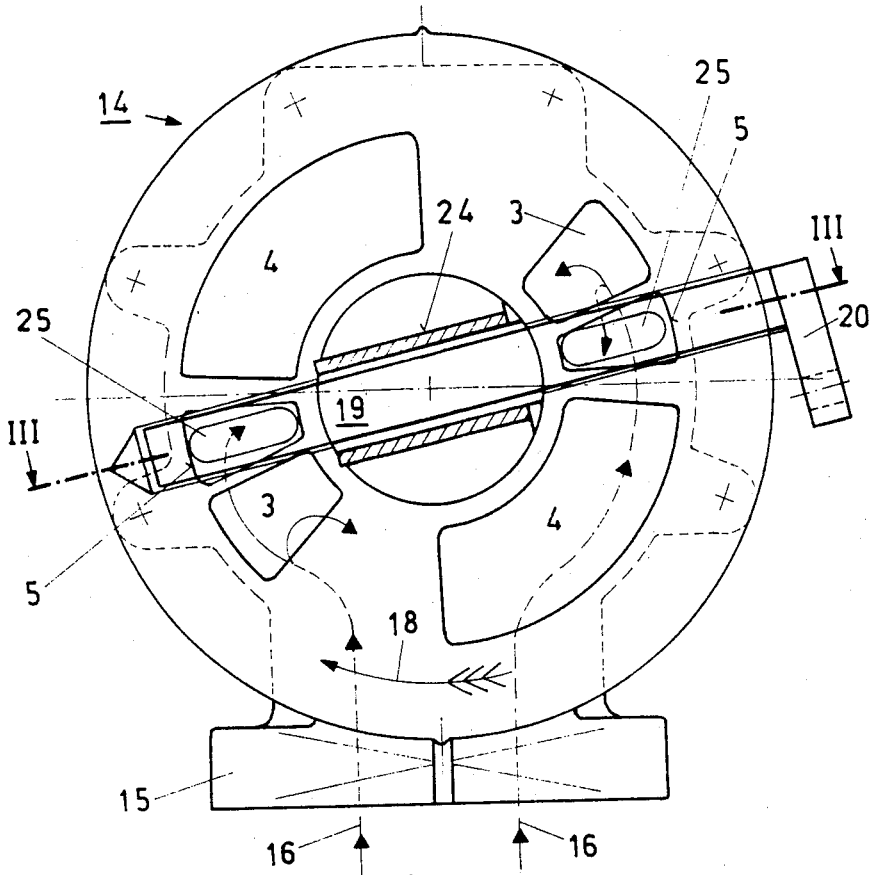

FIGS. 2 and 3 respectively show an end view of the gas casing 14 of a first embodiment form of a pressure wave supercharger according to the invention and a section through the same along the section line III—III drawn in FIG. 2. As in the case of different embodiment forms, still to be discussed, the reference numbers introduced and explained in the description of FIG. 1 are allocated to the main and auxiliary ducts. In the case of the other, physical elements, different reference numbers are introduced in each case in order better to distinguish the different designs from each other.

Figure 15:
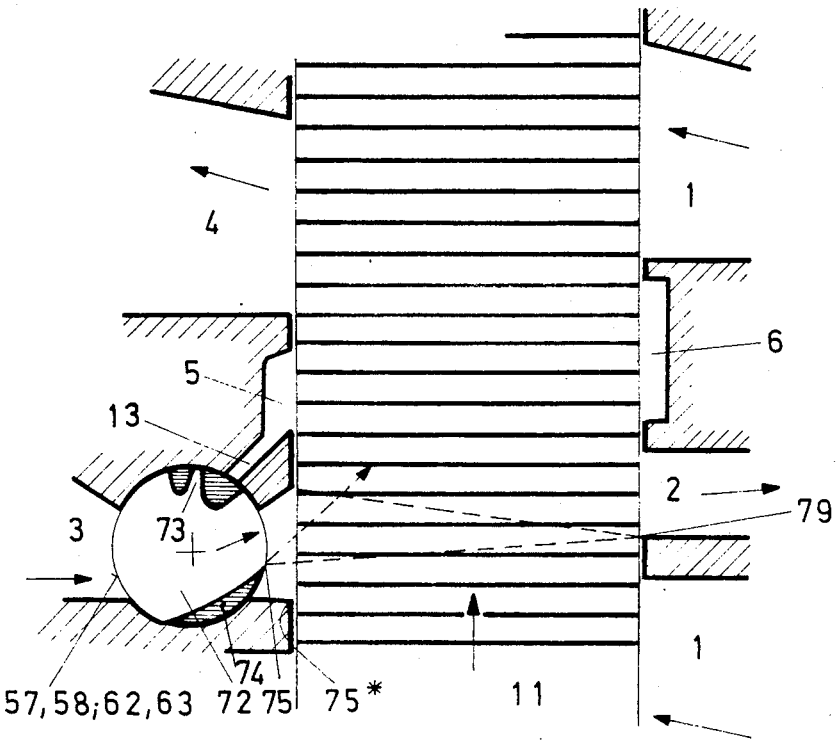

In FIGS. 2 and 3, 15 indicates a flange of the gas casing to which the exhaust gas pipe coming from the engine is attached. The exhaust gas flow is symbolized by the flow arrows 16. The exhaust gas enters the exhaust gas space 17, which is common to both cycles, and is there distributed into the high pressure exhaust gas ducts 3, which can be seen in FIG. 2. The rotational direction arrow 18 indicates the rotational direction of the rotor 11, of which a part, together with its cells 12, is represented in FIG. 3. The exhaust gas part of the pressure wave process also takes place in this direction. The exhaust gas first arrives in each cycle in the high pressure exhaust gas duct 3, from where a partial flow controlled as a function of the operating condition can then be branched off into the gas pocket 5. The exhaust gas expanded in the rotor 11 is scavenged by the low pressure air into the low pressure exhaust gas duct 4, from whence it emerges into the open air through an exhaust duct. The axis of the duct is normal to the plane of the drawing in FIG. 2 and which is not visible in FIGS. 2 and 3. Up to this point, these elements form components of known pressure wave superchargers for the supercharging of vehicle engines.

The element essential to the invention embodies, in the present case, a rotary valve 19 in conjunction with a control device described below. This rotary valve is supported at opposite sides of the casing with sufficient clearance to deal with heating. At the right-hand end, where it has an arm 20, used, for example, for engagement with a rod of a servomotor belonging to the control device mentioned, the bearing is sealed by heat resistant sealing rings and is axially secured by a screw 23 engaging in a peripheral groove 22. For ease of comprehension, this bearing is shown simplified in FIG. 2 and, similarly, the arm 20 in the representation of FIG. 3 is shown rotated by 90° relative to that in FIG. 2.

The central part of the rotary valve 19 is screened against heat effects by a heat protection sleeve 24. This sleeve also prevents the penetration of exhaust gas and soot particles into the hub space of the rotor and hence also into the dirt and heat sensitive rolling contact bearings of the rotor.

The rotary valve 19 penetrates the gas casing 14 on a diameter which is located approximately between the two outlet cross-sections of the high pressure exhaust gas duct 3 and the gas pocket supply duct 13 of the two cycles, which are displaced by 180° relative to one another. The rotary valve has control ducts 25 in the region of the two gas pocket supply ducts 13. Although their outlet cross-sections facing the rotor are shown as congruent, the shape of the ducts between their inlet and outlet can, in practice, be different. This applies to the two variants of the control ducts shown in FIGS. 5 to 8. In these figures, the duct shapes for the first and second cycles are each shown. Their dissimilarity is caused by the mutually differing shapes of the two high pressure exhaust gas ducts symbolized by the flow arrows 16 in FIG. 2, each of which leads from the flange 15 to one of the two cycles and which are of different lengths. The requirement for the same mass flow for both cycles leads, with the internally asymmetrical shape of the gas casing of FIGS. 2 and 3, to this difference in duct shapes, which is essentially caused by the mutually differing flow and temperature conditions in the different length high pressure exhaust gas ducts 3. As a variant from the structural shape shown in the figures discussed, however, the two cycles could also be located symmetrically about the flange 15 so that the two control ducts provided in the rotary valve could then have the same shape. In the present description, however, the gas casing of a pressure wave supercharger designed in practice has, for reasons of simplicity, been selected as the embodiment example.

The cross-sections of the control ducts in FIG. 2 have parallel walls and semi-circular ends. In a modified embodiment of the rotary valve, shown in FIG. 4 and indicated by 26, the control ducts 27 are designed with trapezoid cross-section, which also corresponds approximately to the entry cross-section of the gas pocket supply duct before the rotor. By this means, the complete cross-section of the gas pocket supply duct is utilized for feeding it.

In the two variants of the rotary valve of FIGS. 5 and 6 and FIGS. 7 and 8, respectively, the control ducts of the first cycle and the second cycle are, as mentioned, shaped differently. The angle 0° is allocated to each first cycle and the angle 180° to each second cycle. In the case of the rotary valve 28 of FIGS. 5 and 6, the duct walls of the control ducts 29 and 30 are mutually parallel and, in the case of the rotary valve 31 of FIGS. 7 and 8, the control ducts 32 and 33 narrow down in a nozzle shape towards the gas pocket.

For joint operation together with the engine, the control of the rotary valve must be effected as a function of the operating condition of the engine. For this purpose, a selection of proven conventional open loop and feedback control equipment from the engine field is available, the setting and control movements of this equipment being initiated by sensors which respond to typical process parameters of the engine and supercharger or to parameters typical of the engine.

One control device, which controls the supply to the gas pocket in the desired manner at small cost, is the step motor 54, shown diagrammatically in FIG. 9, which, in association with an electronic control system based on characteristics, analogous to characteristic controlled ignition in spark ignition engines, is ideally suitable for the present object. The armature of such a step motor can be coupled directly and coaxially to the free end surface of the rotary valve or it can be coupled indirectly to it via linkage. As shown, the pivoting angle could, for example, be 70°. An in-process computer 55 of known type programmed to control the step motor can, for example, be equipped with inputs for the supercharge air pressure, the supercharge air temperature, the high pressure exhaust gas temperature and the engine speed. The pulses of these inputs, whose totality is indicated by 56 in FIG. 9, are processed in the inprocess computer into signals for controlling the step motor 54.

In this arrangement, the gas pocket supply is fully open for starting and idling and it would seem possible to omit the automatic starting valve, usually necessary as a starting aid. The pressure ratio can be programmed as a function of the maximum permissible supercharge pressure, i.e., it will not be necessary to accept simplified programming to constant pressure ratio over the whole of the speed range. In the part load range where the maximum permissible supercharge pressure is not reached, the supercharge air temperature can be increased by increasing the pressure ratio. This is advantageous for regenerating the particle filter used for soot separation. Full altitude compensation is possible by closing down the gas pocket supply. Finally, the $No_x$ emission can be reduced at part load by increasing the recirculation.

A further concept for the control of the gas pocket supply is described below using FIGS. 10 to 17.

Figure 10:
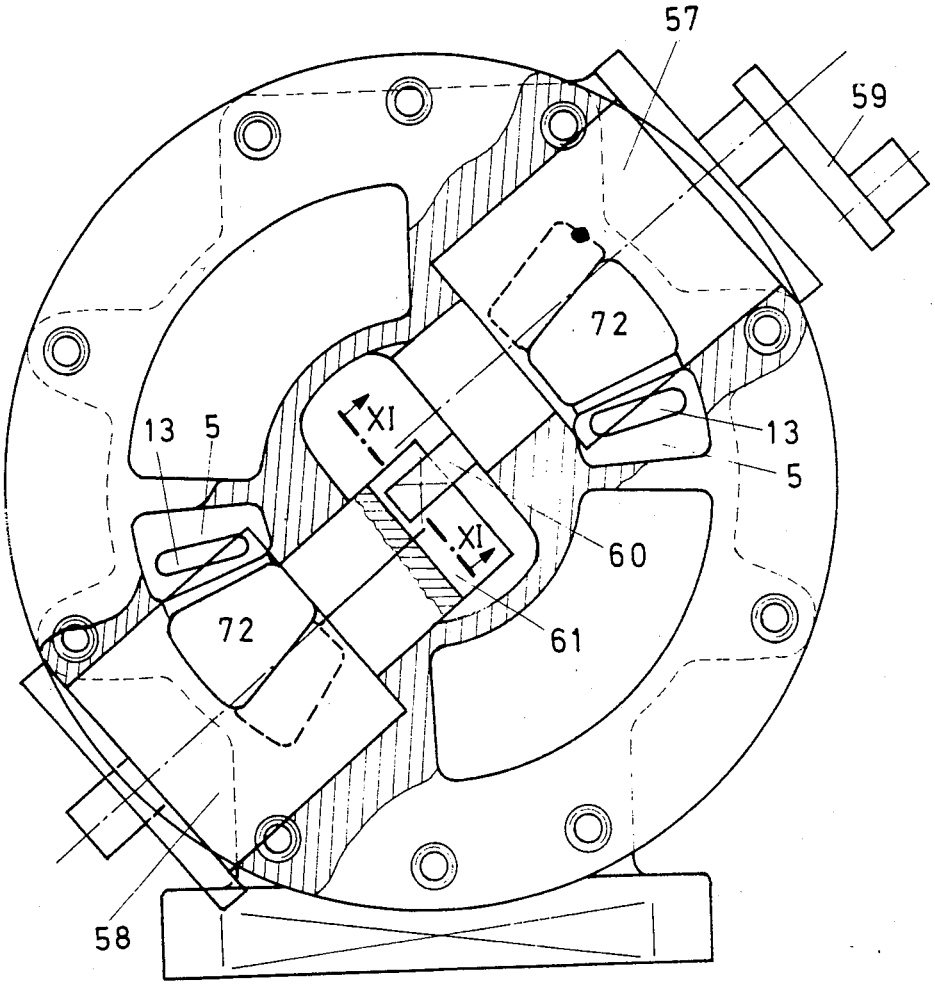
FIGS. 10 to 13 show partially sectioned views and details of gas casings with rotary valves of a different type.
Figure 11:
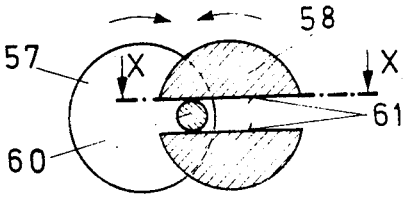

The construction of a first variant of this concept is shown in FIGS. 10 and 11.

As in the first concept, the control of the supply to the gas pocket in this case is based on the principle of the rotary valve, the controling ducts being capable of throttling the high pressure exhaust gas duct and the gas pocket supply duct between "fully open" and "closed", again more or less in a ratio to one another which depends on the operating condition. The difference relative to the embodiment first described consists in the fact that one rotary valve 57 or 58, respectively, is provided for each cycle. These are, however, mechanically positively coupled in such a way that when one is pivoted, for example the one indicated by 57 and provided with a crank arm 59, the other, 58, is pivoted in the opposite direction to the first. For the mechanical coupling of the two rotary valves, the first rotary valve 57 has, at its inner end, a guide pin 60 which slides in a guide groove 61 provided at the inner end of the second rotary valve 58, as can be seen in the section shown in FIG. 11 corresponding to the section line XI—XI of FIG. 10. The opposite pivoting movements of the two rotary valves have the advantage that the control ducts of the rotary valves, which are shown on FIGS. 14 to 17 described below, are polar symmetrical about a point on the rotor axis. They do not therefore need to have different shapes in order to achieve the same flow conditions in both cycles—as does the rotary valve of the first concept in which the control ducts for the two cycles are pivoted in the same direction.

The upper part of the end of the rotary valve, which contains the guide groove 61, is shown sectioned in FIG. 10, corresponding to the section line X—X drawn in FIG. 11.

The pivoting movement exerted on the crank arm 59 for the controlled distribution of the high pressure exhaust gas flow is derived, in a similar manner to the first concept, from the same typical process parameters using known servo devices and sensors.

Figure 12:
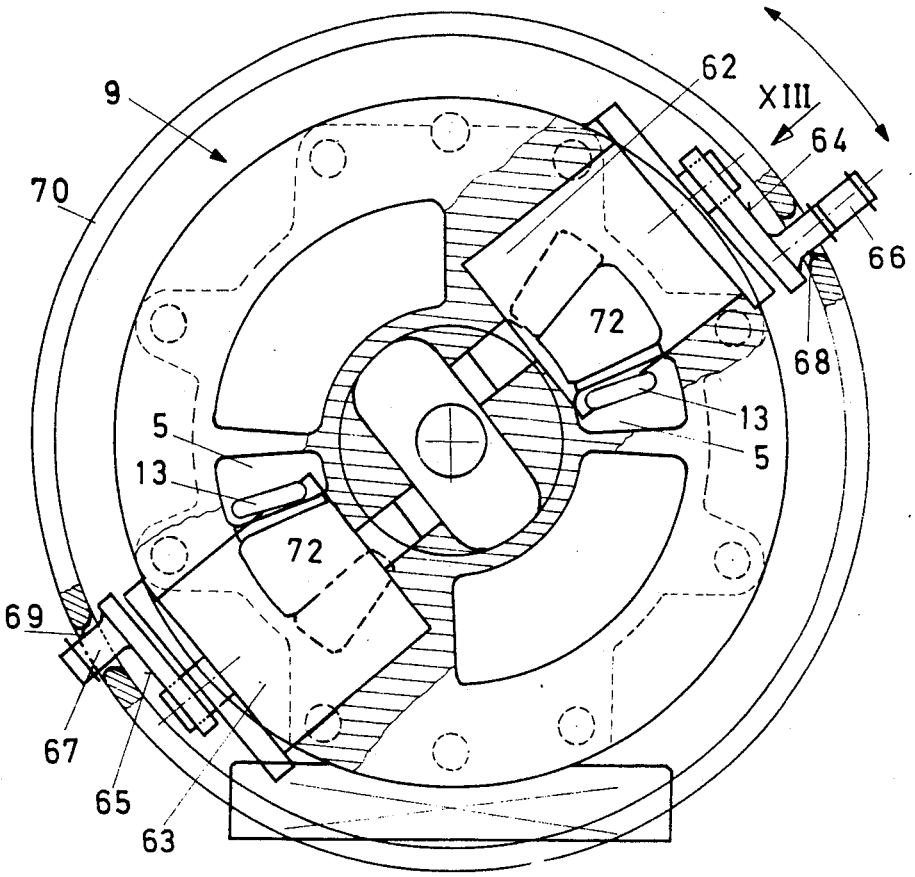
Figure 13:
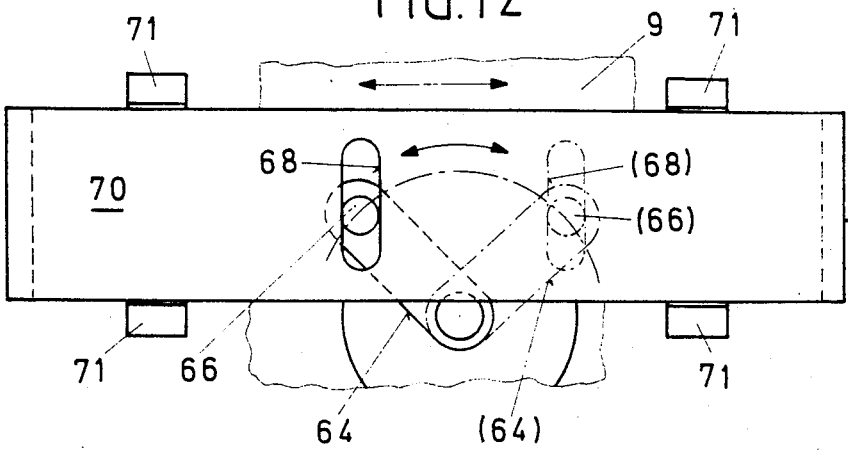

The same also applies to the variant of the second concept shown in FIGS. 12 and 13. This differs from that of FIGS. 10 and 11 only in a different positive mechanical coupling system for the two rotary valves 62 and 63. They each have a crank arm 64 and 65, whose respective crank pins 66 and 67 are guided, respectively, in guide slots 68 and 69 (parallel to the rotor axis) of a coupling ring 70 surrounding the gas casing 9. The guidance for the coupling ring is indicated diagrammatically in FIG. 13 by guide blocks 71.

A rod of the control device described above engages on the longer crank pin 66, which extends beyond the boundaries of the coupling ring 70, and pivots the rotary valve 62 during a servo movement. The coupling ring 70 is simultaneously rotated by the crank pin 66 so that the crank arm 65 and hence the rotary valve 63 for the second cycle is pivoted through the same angle as the crank arm 64 and the rotary valve 62 of the first cycle. As in the first variant shown in FIGS. 10 and 11, the rotary valves are pivoted in opposite directions so that the control ducts and the supply ducts to the gas pockets can have the same shape in both cycles. The two end positions of the crank arm 64 can be seen in FIG. 13, the reference numbers in brackets referring to what is considered as the right-hand end position, which is shown chain-dotted.

This rotating valve coupling is also suitable for pressure wave superchargers with more than two cycles, for example for one with three cycles, which may achieve pratical importance in the future.

The control ducts in the rotary valves of the two variants mentioned above, shown in cross-section in FIGS. 14–17, should make a satisfactory pressure wave process possible in the following operating ranges:

In idling and during starting, for which a conventional starting valve is no longer necessary, and during emergency operation which, in the case of a breakdown, should make it possible for the vehicle to be driven home under its own power;

Operation at part load and full load in the lower speed range; and

Operation at part load and full load in the upper speed range.

Figure 4:
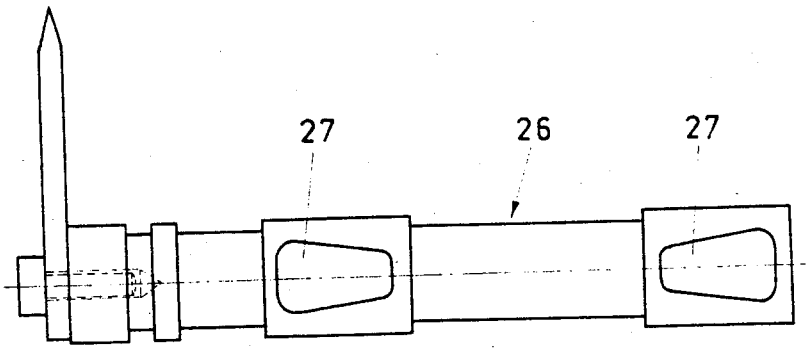
FIG. 4 shows a rotary valve as part of the device of FIGS. 2 and 3, FIGS. 5 to 8 show, in section, the control ducts of two different designs of rotary valves.
Figure 5:
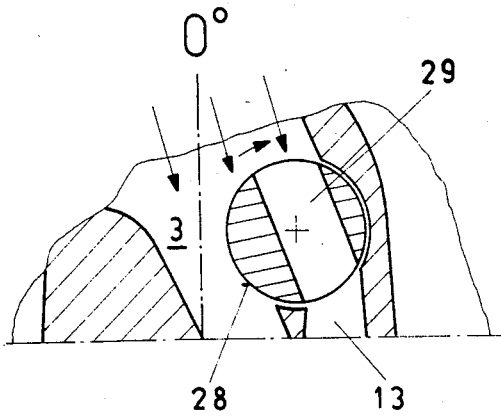
Figure 6:
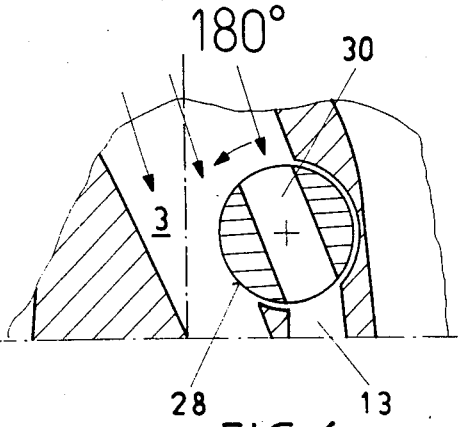
Figure 7:
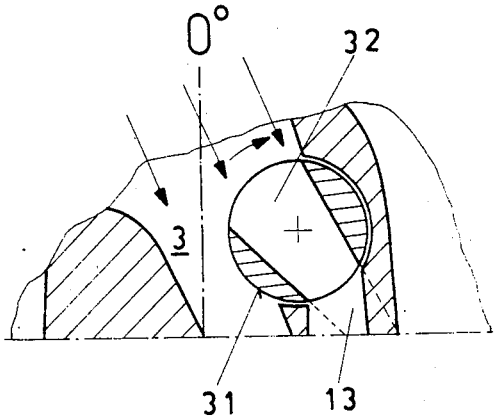
Figure 8:
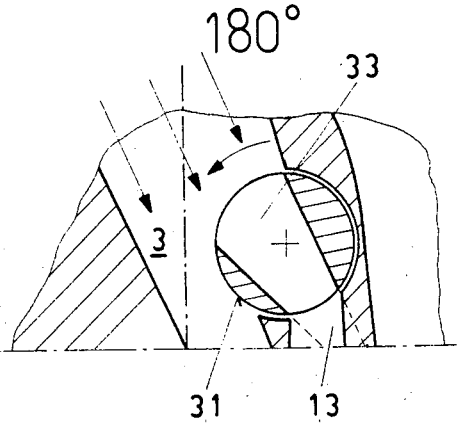
Figure 14:
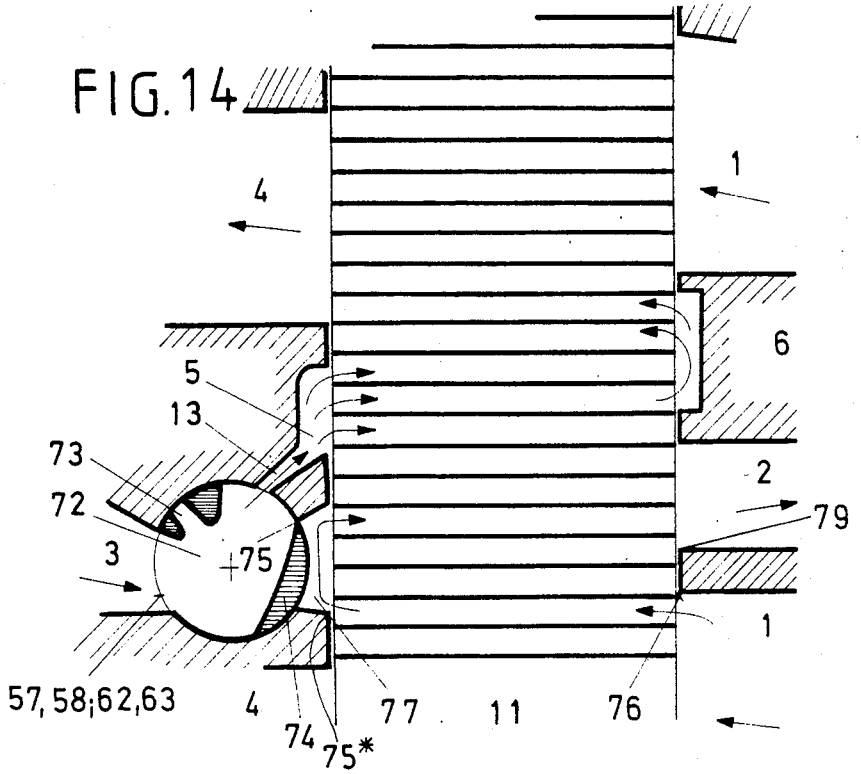
FIGS. 14 to 16 show, in section, various positions of rotary valves for the gas casings shown in FIGS. 10 and 12.
Figure 16:
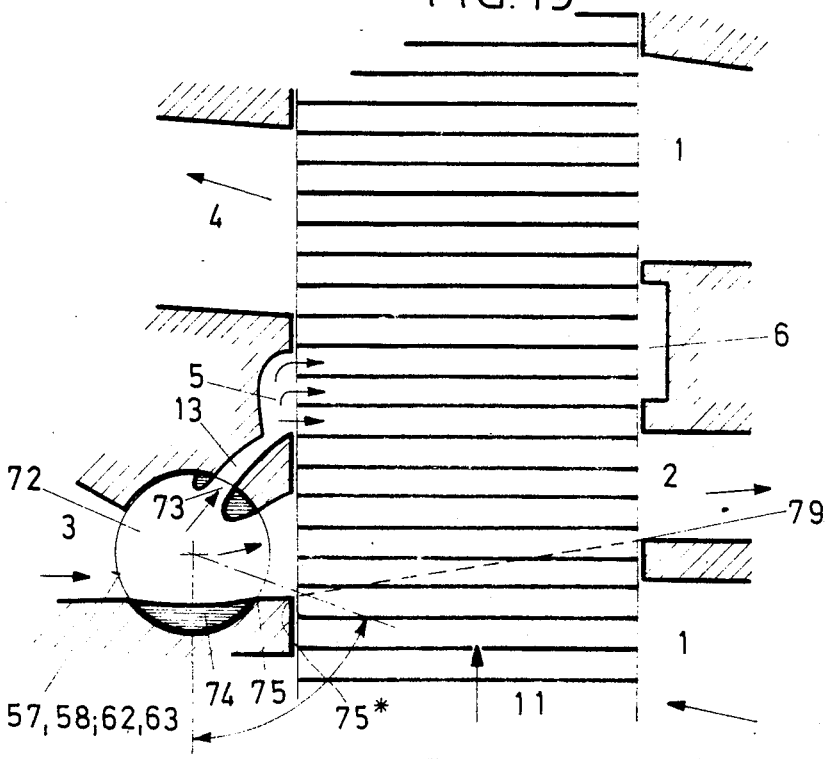

These requirements are met, in the design according to FIGS. 14–16, by an additional duct relative to the design of the first concept. This can involve one of the rotary valves provided in pairs according to one of the FIGS. 10 or 12, or a design of equivalent concept. It can also involve a rotary valve as shown in FIG. 4. An auxiliary control duct 73, which is narrower than a main control duct 72, branches off from the latter, whose cross-section is substantially equal to that of the high pressure exhaust gas duct 3. In this case, however, the cylindrical body of this rotary valve covers both the cross-section of the high pressure exhaust gas duct 3 and the opening on the rotary valve side of the gas pocket supply duct 13. In the concept first described, the cylinder of the rotary valve 19 only partially covers the high pressure exhaust gas duct under all operating conditions. In the case of the concept last mentioned, the control edge geometry of the high pressure exhaust gas duct, i.e., its position relative to the high pressure air duct 2 and also, if appropriate, to a compression pocket 7, remains unaltered, while it permits a rotary valve pair 57+58 and 62+63 to displace the opening edge of the high pressure exhaust gas duct 3 within the outlet cross-section of the duct 3, corresponding to the particular operating condition. This opening edge is the edge, indicated by 75, of the crescent moon shaped residual cross-section 74 of the rotary valve in the region of the control ducts.

One of the rotary valves 57, 58, 62 and 63 represented in FIGS. 10 and 12 is shown in its position for various operating ranges in FIGS. 14, 15 and 16. FIG. 14 shows the position for engine idling and for emergency operation, which makes it possible to drive the vehicle home under its own power. The crescent moon shaped residual cross-section 74 completely shuts off the high pressure exhaust gas duct 3 in this case and the gas pocket supply duct is open so that, ignoring leakage, the exhaust gas can only reach the rotor via the gas pocket 5. The exhaust gas from the duct 3 cannot, therefore, affect conditions in the high pressure air duct 2. A slight overlap of the duct 3 by the low pressure air duct 1, i.e., the closing edge 76 of the duct 1 is reached later by a rotor call (seen in the direction of rotation of the rotor) than the solid opening edge 75* of the duct 3, makes it possible for sufficient low pressure air from the duct 1 to flow over into the duct 2, via a rotor cell and an auxiliary pocket 77, which is formed by the mouth region of the duct 3 closed by the rotary valve, for the engine to be started and run at idling. If the rotor is jammed due to a failure, the air induced via the duct 1, the rotor cells and the pocket 77 is sufficient for the emergency operation of the vehicle already mentioned.

So that the auxiliary pocket 77 can be formed, the requirement to place the rotary valve as close as possible to the end surface of the rotor is ignored, although this would be better at full load because of the unavoidable leakage. An improvement in this respect is obtained by a recess 78 on the back of the crescent moon shaped residual cross-section 74 and shown dotted in FIG. 17. The rotary valve can be located closer to the rotor by this means but the auxiliary pocket 77 still remains sufficiently large.

FIG. 15 shows the rotary valve in an intermediate position with the duct 3 about two thirds open and the supply duct 13 for the gas pocket 5 closed. This is the position for part load and full load operation at low speeds. The pivoting of the rotary valve into this position is initiated when a low supercharge pressure, whose magnitude is substantially equal to the response threshold of a starting valve used in conventional pressure wave superchargers, is reached. In this position, the main control duct 72 deflects the exhaust gas at a steep angle against the walls of the rotor cells, which is desirable particularly in the case of free running pressure wave superchargers without a positive drive. The small mutual displacement of the opening edges 75 and 79 of the high pressure exhaust gas duct 3 and the high pressure air duct 2, respectively, then gives favorable matching for the high-pressure side pressure wave process at low speeds and it is then possible to omit a compression pocket 7 before the duct 2. Since the gas pocket supply duct 13 is closed in this position, the whole of the exhaust gas energy is available for the compression process.

The end position of the rotary valve at part load and full load in the high speed range is given in FIG. 16. In this position, the main control duct 72 and the gas pocket supply duct 30 are fully open. The adjustment range of the rotary valve is between the position of FIG. 15 and this end position. Optimum matching of the high-pressure side pressure wave process is substantially retained and recirculation of exhaust gas into the charge air pipe is largely avoided. Charge pressure limitation occurs by deflecting surplus exhaust gas into the gas pocket 5 and this supports the low pressure scavenging.

Figure 17:
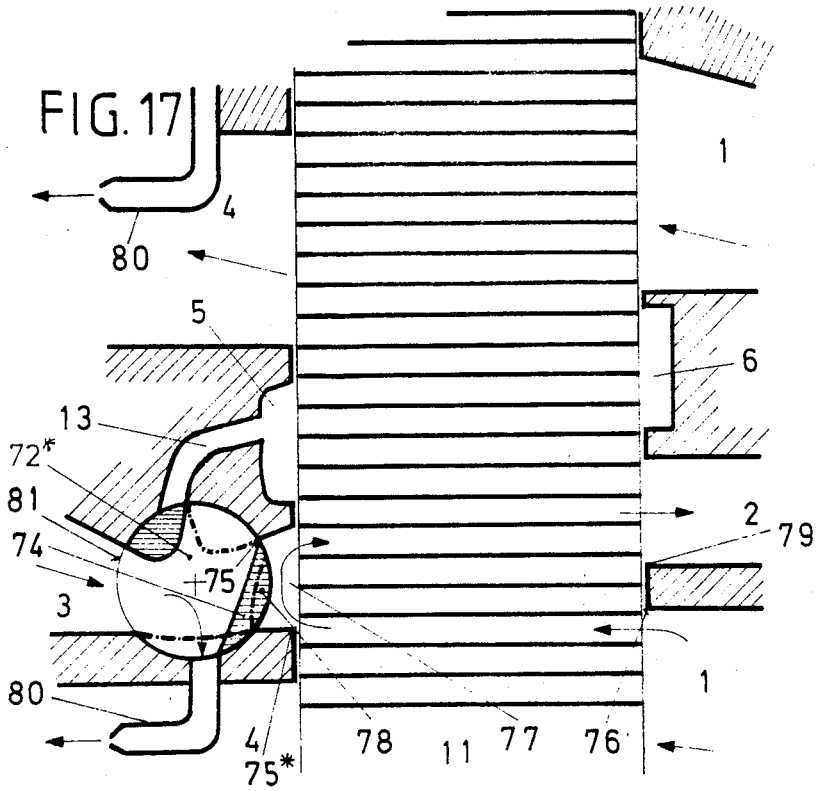
FIG. 17 shows a variant of a rotary valve of the type mentioned above.

FIG. 17 shows a variant of the previously described control system, low pressure scavenging being supported by branching off, via an ejector nozzle 80, a part of the high pressure exhaust gas from the duct 3 into the low pressure exhaust gas duct 4. The associated rotary valve 81 has only one control duct 72* and the position indicated by full lines corresponds to that of the rotary valve in FIG. 14, i.e. idling and emergency operation are involved. The position shown chain-dotted corresponds to that of FIG. 16, i.e. the end position at part load and full load in the upper speed range. The duct 3 and the supply duct 13 are, therefore, fully open. The recess 78, which can, if necessary, be provided to increase the auxiliary pocket 77 if the rotary valve is placed as near as possible to the rotor, is also shown chain-dotted.

The same means as those in the concept first described can be used for adjusting the rotary valve. Here again, characteristic curves control is the most advanced solution for the purpose of achieving the best possible matching of the supercharger to the operating behavior demanded by the engine. The most favorable positions of the rotary valve are stored as a characteristic field in an electronic control unit as a function of the engine speed or, in the case of free running pressure wave superchargers, of the rotor speed and the mean effective pressure—represented by the control rod displacement of the injection pump—it being also possible to store other data important to engine operation, for example the parameters dependent on the condition, i.e., dirtiness, of a particle filter.

Figure 18:
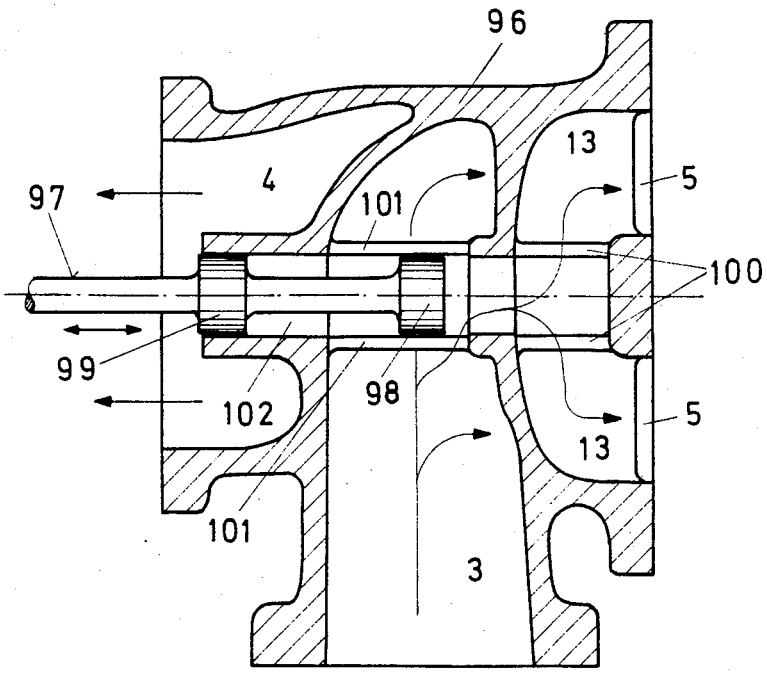
FIGS. 18 to 20 show a further design of a device according to the invention with a piston valve, shown in a longitudinal section of a gas casing in three different positions.
Figure 19:
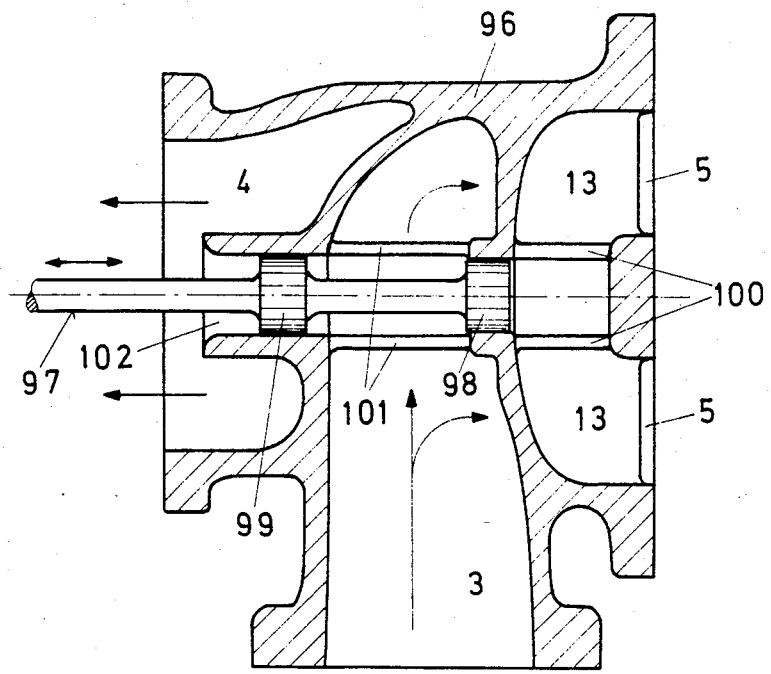
Figure 20:
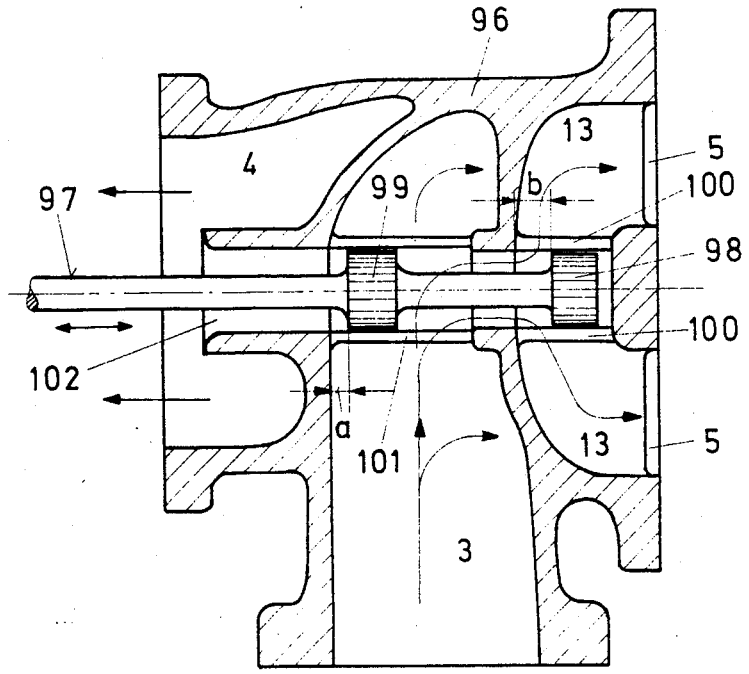

The control element of a third concept for controlling the supply to the gas pocket, represented in FIGS. 18 to 20, is a piston valve 97, which passes through the high pressure exhaust gas duct 3 and the low pressure exhaust gas duct 4 in a gas casing 96 and which can be displaced into the beginning of the two gas pocket supply ducts 13 of the gas pockets 15 provided for the two cycles. The piston valve 97 has a gas pocket piston 98 and a wastegate piston 99, of which the first opens and closes the supply to the gas pocket and the second does the same for the wastegate. When they are outside their closed positions, the two pistons are guided between guide ribs 100 and 101 which extend right through the high pressure exhaust gas duct 3 transverse to the gas pocket supply ducts 13.

FIG. 18 shows the position of the piston valve 97 for idling and emergency operation. The gas pocket piston 98 permits flow to the gas pockets; the wastegate duct 102, which blows down excess high pressure exhaust gas into the low pressure exhaust gas duct in the case of excessive charge pressure, is closed by the wastegate piston 99.

At part load and lower full load, both the wastegate duct 102 and the gas pocket supply ducts 13 are closed, as is shown in FIG. 19. All the high pressure exhaust gas is available for compression work.

In the upper full load range, with a surplus supply of high pressure exhaust gas, the wastegate and gas pocket supply ducts are open, see FIG. 20, the relationship $a<b$ applying to the opening strokes a and b.

In this concept and the second concept, the pressure wave process of the two cycles occurs symmetrically because of the similarly shaped ducts. In the case of the design with a piston valve, the two gas pockets 5 also have a common supply duct 13.

Figure 21:
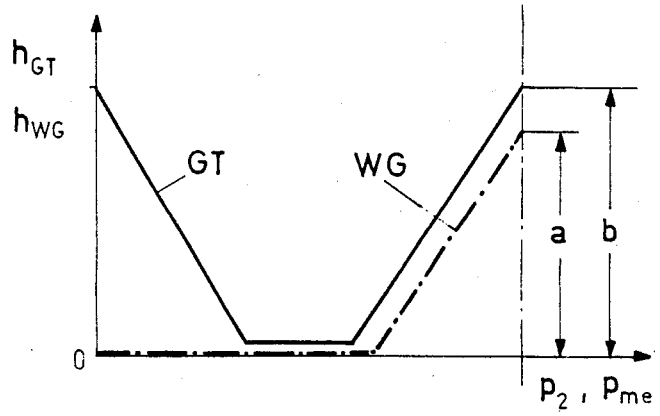
FIG. 21 shows a diagram which, in simplified form, indicates the stroke of the piston valve as a function of the operating condition of the engine.

The control of the piston valve can be effected by sensors and servos of known type in an analogous manner to that of the two concepts first described. FIG. 21 shows the relationship between the opening strokes $h_{GT}$ and $h_{WG}$ of the ducts 13 and 102, the control taking place as a function of the supercharge pressure $p_2$ and the mean effective pressure $p_{me}$ of the engine.

What is claimed is:

1. In a pressure wave supercharger for an internal combustion engine of the type having a device for controlling the high pressure exhaust gas flow, having one or more cycles, gas and air casings and a rotor casing with a cell rotor enclosed between these two casings, main and auxiliary ducts for the supply and removal of high pressure and low pressure exhaust gas and of low pressure and high pressure air being provided in the gas casing and in the air casing, the main ducts consisting of a low pressure air duct and a high pressure air duct in the air casing and of a high pressure exhaust gas duct and a low pressure exhaust gas duct in the gas casing and one of the auxiliary ducts being a gas pocket which is provided on the end surface of the gas casing facing towards the cell rotor, which gas pocket is located behind the high pressure exhaust gas duct, viewed in the direction of rotation of the rotor, and is connected to the high pressure exhaust gas duct via a gas pocket supply duct, the improvement wherein the device for controlling the high pressure exhaust gas flow has a control element which is controllable from a servo motor which can be activated by signal means which respond to parameters typical of the pressure wave process and the engine operating process, and wherein the control element can be adjusted in such a way that it can at least partially shut off both the partial flow through the gas pocket supply duct and the main flow through the high pressure exhaust gas duct.

2. Pressure wave supercharger as claimed in claim 1, wherein the control element is an integral rotary valve whose control ducts have boundary walls parallel to one another or narrowing down in nozzle shape.

3. Pressure wave supercharger as claimed in claim 1, having two cycles, wherein each cycle is provided with its own rotary valve, wherein these rotary valves are coupled together by mechanical means in such a way that they are pivoted by a control movement in the same sense relative to their cycle, and wherein the rotary valves are located in the high pressure exhaust gas ducts in such a way and their control ducts are so designed that they can change the flow cross-section of the high pressure exhaust gas duct and the gas pocket supply duct steplessly between "fully open" and "fully closed".

4. Pressure wave supercharger as claimed in claim 3, wherein the means for mechanically coupling the two rotary valves consists of a guide groove on the inner end of one rotary valve and of a guide pin, which can slide in this guide groove, at the inner end of the other rotary valve, and wherein the guide pin is located eccentrically to the axis of the associated rotary valve.

5. Pressure wave supercharger as claimed in claim 3, wherein the means for mechanically coupling the two rotary valves has a coupling ring having guide slots parallel to the rotor axis and one crank arm with a crank pin on each rotary valve, the crank pins being guided in the guide slots and one of the crank pins being intended for mechanical coupling to a servo motor, and wherein guide blocks are provided for guiding the coupling ring.

6. Pressure wave supercharger as claimed in claim 3, wherein the rotary valves have a main control duct for changing the flow cross-section of the high pressure exhaust gas ducts and an auxiliary control duct for changing the flow cross-section of the gas pocket supply ducts, and wherein the rotary valves have a crescent moon shaped residual cross-section in the region of the high pressure exhaust gas ducts, one edge of which residual cross-section acts as an adjustable opening edge for the high pressure exhaust gas duct.

7. Pressure wave supercharger as claimed in claim 3, wherein the rotary valve has a single control duct which is intended to communicate with both the high pressure exhaust gas duct and the gas pocket supply duct, and wherein there is an ejector nozzle which leads from the high pressure exhaust gas duct into the preceding low pressure exhaust gas duct and can be shut off by the crescent moon shaped residual cross-section of the rotary valve.

8. Pressure wave supercharger as claimed in claim 3, wherein the crescent moon shaped residual cross-section has a recess on its outer side to form an auxiliary pocket.

9. Pressure wave supercharger as claimed in claim 1, having a wastegate duct coaxial with the rotor axis and entering into the low pressure exhaust gas duct, wherein the gas pockets of all the cycles have a common gas pocket supply duct, and wherein the control element is designed as a piston valve, which passes through the gas casing coaxially with the rotor and has a gas pocket piston and a wastegate piston intended for steplessly changing the inlet cross-sections to the gas pockets and to the wastegate duct.

10. Pressure wave supercharger as claimed in claim 1, wherein the servo motor is a step motor with characteristics control by an in-process computer, which step motor is directly and coaxially connected to the control element.

11. Pressure wave supercharger as claimed in claim 10, wherein the characteristic field control of the step motor is so designed that it controls the control element by means of a signal derived from the high pressure air pressure ($p_2$) and from the mean effective pressure ($p_{me}$) of the engine cylinder in such a way that the opening of the gas pocket supply duct, starting with the lowest idling range, decreases with increasing load until it reaches zero, while the wastegate duct remains closed in this load interval, after which, in a subsequent part load range and the lower full load range, the gas pocket supply ducts and the wastegate duct remain closed and, in an upper full load range, both the gas pocket supply ducts and also the wastegate duct are open.

* * * * *